US006145147A

United States Patent [19]

Frecska

[11] Patent Number: 6,145,147

[45] Date of Patent: Nov. 14, 2000

[54] APPARATUS FOR CLEANING

[76] Inventor: Tamas S. Frecska, 3645 Meridale Rd., Sarasota, Fla. 34233

[21] Appl. No.: 09/175,596

[22] Filed: Oct. 20, 1998

Related U.S. Application Data

[60] Provisional application No. 60/062,551, Oct. 21, 1997.

[51] Int. Cl.[7] ..... B08B 1/04; B08B 3/04

[52] U.S. Cl. ..... 15/77; 15/88.2

[58] Field of Search ..... 15/21.1, 77, 88, 15/88.2, 88.3

[56] References Cited

U.S. PATENT DOCUMENTS

| | | | |
|---|---|---|---|
| 981,417 | 1/1911 | Halsey et al. | 15/88.2 X |
| 2,273,514 | 2/1942 | Chamberlin | 15/77 |
| 2,376,945 | 5/1945 | Stine | 15/88.2 |
| 2,472,155 | 6/1949 | Gaino | 15/77 |
| 3,020,978 | 2/1962 | Bocchino | 15/77 X |
| 3,761,984 | 10/1973 | Hauschild et al. | 15/88.3 |

FOREIGN PATENT DOCUMENTS

| | | | |
|---|---|---|---|
| 129598 | 4/1902 | Germany | 15/88.3 |

*Primary Examiner*—Mark Spisich
*Attorney, Agent, or Firm*—Frijouf, Rust & Pyle, P.A.

[57] ABSTRACT

An apparatus and method is disclosed for cleaning a longitudinally extending member with a cleaning fluid. The apparatus comprises a reservoir for holding the cleaning fluid. A first and a second cleaning component are mounted for rotation with at least a portion of the first and second cleaning components extending into the reservoir for contacting the fluid cleaner therein. The first and second rotating cleaning components clean the longitudinally extending member upon the insertion of the longitudinally extending member between the first and second cleaning components.

8 Claims, 7 Drawing Sheets

APPARATUS FOR CLEANING

CROSS-REFERENCE TO RELATED APPLICATIONS

This application claims benefit of United States Patent Provisional application Ser. No. 60/062,551 filed Oct. 21, 1998. All subject matter set forth in provisional application Ser. No. 60//062,551 is hereby incorporated by reference into the present application as if fully set forth herein.

BACKGROUND OF THE INVENTION

1. Field of the Invention

This invention relates to cleaning and more particularly to an apparatus and a method for cleaning a longitudinally extending member such as a tool or workpiece with a plurality of cleaning components such as a plurality of cleaning brushes and a cleaning solvent.

2. Background of the Invention

Various types of apparatuses and machines have been proposed in the art for cleaning workpieces and the like. In many cases, the tool or workpiece is immersed within a reservoir containing a cleaning solvent for cleaning workpieces and the like. To further assist in the cleaning process, agitation or brushing may be undertaken within the reservoir for cleaning the tools or workpieces.

Difficultly is encountered when the tool or workpiece is of an awkward shape. For example, the tool or workpiece may have a relatively small cross-section but have a relatively long longitudinal length thereby defining a longitudinally extending member. The long longitudinal length of the longitudinally extending member prohibits the immersion of the tool or workpiece into many of the cleaning tanks of the prior art.

A specific example of a tool that defines a longitudinally extending member is a squeegee found in the screen printing process. In the screen printing process, a screen having a multiplicity of pores is stretched within a frame. The multiplicity of pores are selectively blocked for providing an image with the unblocked pores. The screen is placed upon a printing substrate and a printing pigment is pressed through the unblocked pores of the screen onto the printing substrate. The printing pigment is generally pressed through the pores of the screen with the use of a squeegee. Upon removal of the screen, an image formed by the printed pigment remains on the printing substrate.

The squeegee comprises a longitudinally extended handle for supporting a resilient longitudinally extending squeegee blade. The squeegee blade typically comprises a first and a second lateral surface and a bottom surface. The first and second lateral surfaces are parallel to one another and are generally disposed perpendicular to the bottom surface. Printing squeegees may be found in various lengths from one to six feet depending on the size of the printing task.

After the printing process is completed, the squeegee must be cleaned for re-use. Some in the prior art have attempted to provide a machine for cleaning a printing squeegee. U.S. Pat. No. 5,572,760 disclosed an apparatus with a rotatable frame located within a housing. The printing squeegee was placed on the frame and a cleaning fluid was sprayed onto the squeegee. Plural slidable scrubbers scrubbed each of the printing squeegee.

Unfortunately, U.S. Pat. No. 5,572,760 was complicated and expensive and will not receive a printing squeegee having a large longitudinal length. Furthermore, the complexity of this apparatus made the apparatus difficult to clean. The aforementioned patent also had the disadvantage of cleaning the squeegee handle along with the squeegee blade.

Therefore, it is an object of this invention to provide an improved apparatus for cleaning a longitudinally extending member wherein the apparatus is capable of cleaning the longitudinal extending member irrespective of the longitudinal length thereof.

Another object of this invention is to provide an improved apparatus for cleaning a longitudinally extending member wherein the longitudinally extending member is cleaned without an immersion process.

Another object of this invention is to provide an improved apparatus for cleaning a longitudinally extending member wherein the squeegee blade can be cleaned without immersing the squeegee handle.

Another object of this invention is to provide an improved apparatus for cleaning a longitudinally extending member wherein the apparatus comprises a first, second, and third cleaning component for respectively cleaning a first and a second lateral surface and a bottom surface.

Another object of this invention is to provide an improved apparatus for cleaning a longitudinally extending member wherein the longitudinally extending member may be passed through the apparatus by hand or automated means.

Another object of this invention is to provide an improved apparatus for cleaning a longitudinally extending member wherein the longitudinally extending member may be passed through the apparatus a second time in the remote event the longitudinally extending member was not totally cleaned the first time.

Another object of this invention is to provide an improved apparatus for cleaning a longitudinally extending member wherein the longitudinally extending member may be passed through the improved apparatus at a rate sufficient to enable the improved apparatus to thoroughly clean the longitudinally extending member.

Another object of this invention is to provide an improved apparatus for cleaning a longitudinally extending member wherein the improved apparatus is inexpensive and is small in size.

Another object of this invention is to provide an improved apparatus for cleaning a longitudinally extending member wherein the improved apparatus is easy to clean.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention and the detailed description describing the preferred embodiment of the invention.

SUMMARY OF THE INVENTION

A specific embodiment of the present invention is shown in the attached drawings. For the purpose of summarizing the invention, the invention relates to an improved apparatus for cleaning a longitudinally extending member with a cleaning fluid comprising a reservoir for holding the cleaning fluid. A first and a second cleaning component are mounted for rotation with at least a portion of the first and a second cleaning components extending into the reservoir for contacting the fluid cleaner therein. The first and second cleaning components clean the longitudinally extending member upon the insertion of the longitudinally extending member between the first and second cleaning components.

In a more specific embodiment of the invention, the first and second cleaning components respectively clean at least a first and a second lateral side of the longitudinally extending member. A third cleaning component may be disposed intermediate of the first and second cleaning components for cleaning a bottom surface of the longitudinally extending member. Preferably, the third cleaning component is disposed intermediate the first and second cleaning components and is smaller than the first and second cleaning components.

In still a more specific embodiment of the invention, the apparatus comprises a frame supporting a reservoir for holding the cleaning fluid. An axle is rotatably supported relative to the frame and located above the reservoir. A first and a second cleaning brush is mounted for rotation on the axle with at least a portion of the cleaning component extending into the reservoir for contacting the fluid cleaner therein. A motor is operatively connected to the axle for rotating the first and second cleaning brushes to clean the longitudinally extending member upon the insertion of the longitudinally extending member between the first and second cleaning brushes.

The first and second cleaning brushes comprise a first and second substantially circular support defining a first and second periphery. A first and second plurality of cleaning brushes extend axially from the first and second peripheries of the first and second circular support with the first and second plurality of cleaning brushes being disposed in a facing relationship for respectively cleaning at least a first and a second lateral side of the longitudinally extending member. A third brush comprises a third circular support defining a third periphery disposed on the axle intermediate of the first and second circular supports. A third plurality of cleaning brushes extend radially outwardly from the third periphery of the third circular support for cleaning a bottom surface of the longitudinally extending member. Preferably, the third circular support has a smaller diameter that the first and second circular supports.

The reservoir comprises an open top container. An output tray may be secured relative to the frame for receiving cleaning fluid draining from the longitudinally extending member and returning the cleaning fluid to the reservoir.

The apparatus may include a first and a second removable cover for covering the first and second cleaning brushes, respectively. The first and second removable cover defines a slot therebetween for enabling the introduction of the longitudinally extending member therethrough for insertion between the first and second cleaning brushes. A first and a second flexible brush cover the slot to enclose the first and second cleaning brushes while enabling the longitudinally extending member to be inserted through the slot upon deflection of the first and second flexible brushes.

The apparatus may include an input scraper for scraping the first and second lateral side of the longitudinally extending member prior to engagement of the longitudinally extending member with the first and second cleaning brushes. An output scraper may be provided for removing remaining cleaning fluid from the longitudinally extending member.

The invention is also incorporated into the method of cleaning a first and a second lateral surface of a printing squeegee with a cleaning fluid located within a reservoir, comprising the steps of rotating a first and a second cleaning component to at least partially extend into the cleaning fluid within the reservoir and moving the printing squeegee between the first and second cleaning components for cleaning the first and second lateral surfaces of the printing squeegee.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
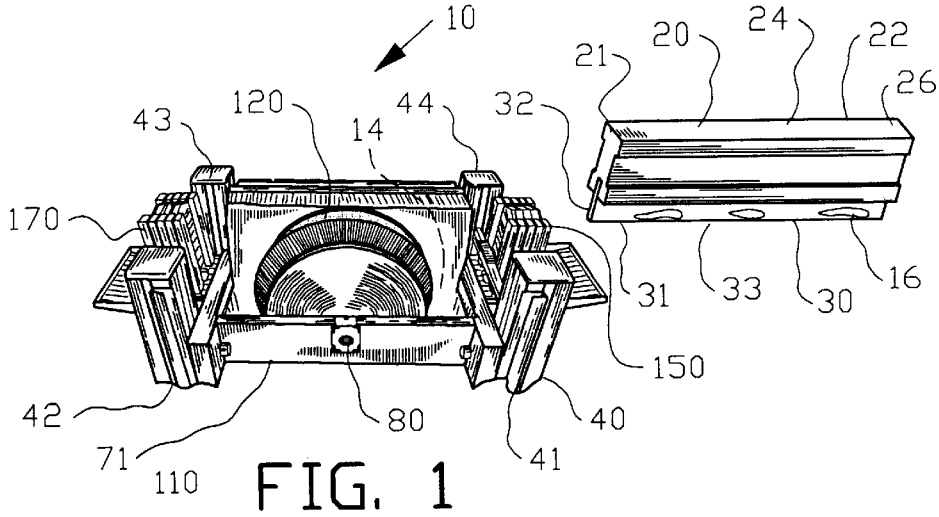
FIG. 1 is an isometric view of a longitudinally extending member being positioned adjacent to the cleaning apparatus of the present invention.

FIG. 1 is a top perspective view of the apparatus 10 of the present invention utilizing a cleaning fluid 14 for cleaning an accumulated material 16 from a longitudinally extending member 20. The longitudinally extending member 20 extends between a first and a second end 21 and 22 and is characterized as having a greater longitudinal length than the cross-sectional length. In this example, the longitudinally extending member 20 has been shown in a truncated form but it should be understood that the longitudinally extending member 20 could be extremely long in length.

The longitudinally extending member 20 may be a tool or a workpiece. In this example, the longitudinally extending member 20 is shown as a printing squeegee 24 for use in a screen printing process. The printing squeegee 24 comprises a handle 26 supporting a semi-flexible blade 30. The blade 30 is defined by a substantially rectangular cross-section having a first and a second lateral side 31 and 32 terminating in a bottom surface 33. Although the blade 30 has been shown to have a substantially rectangular cross-section, it should be understood that longitudinally extending member 20 may have various shapes of cross-section. In this example, the accumulated material 16 on the longitudinally extending member 20 is shown as an accumulation of printing pigment 16 which is representative of the printing squeegee 24 after completion of a screen printing process.

As further shown in FIGS. 4–8, the apparatus 10 comprises a frame 40 having a plurality of vertical supports 41–44 interconnected by a plurality of horizontal supports. A reservoir 50 is supported by the frame 40 for holding the cleaning fluid 14 therein. Preferably, the reservoir 50 is shown as an open top container having a plurality of sides 51–54 and a bottom 55. The reservoir 50 is provided with a drain 60 having a valve 62 for draining the cleaning fluid 14 and any accumulated printing pigment 16 therefrom.

A first and a second axle support 71 and 72 are mounted to the frame 40. A first and a second axle insert 71A and 72A are slidably received within keyed recesses 71B and 72B defined within the first and second axle supports 71 and 72. The first and second axle inserts 71A and 72A journal an axle 80 having a first and a second end 81 and 82. The axle 80 is rotatable about a substantially horizontal axis and is located above the reservoir 50.

Figure 6:
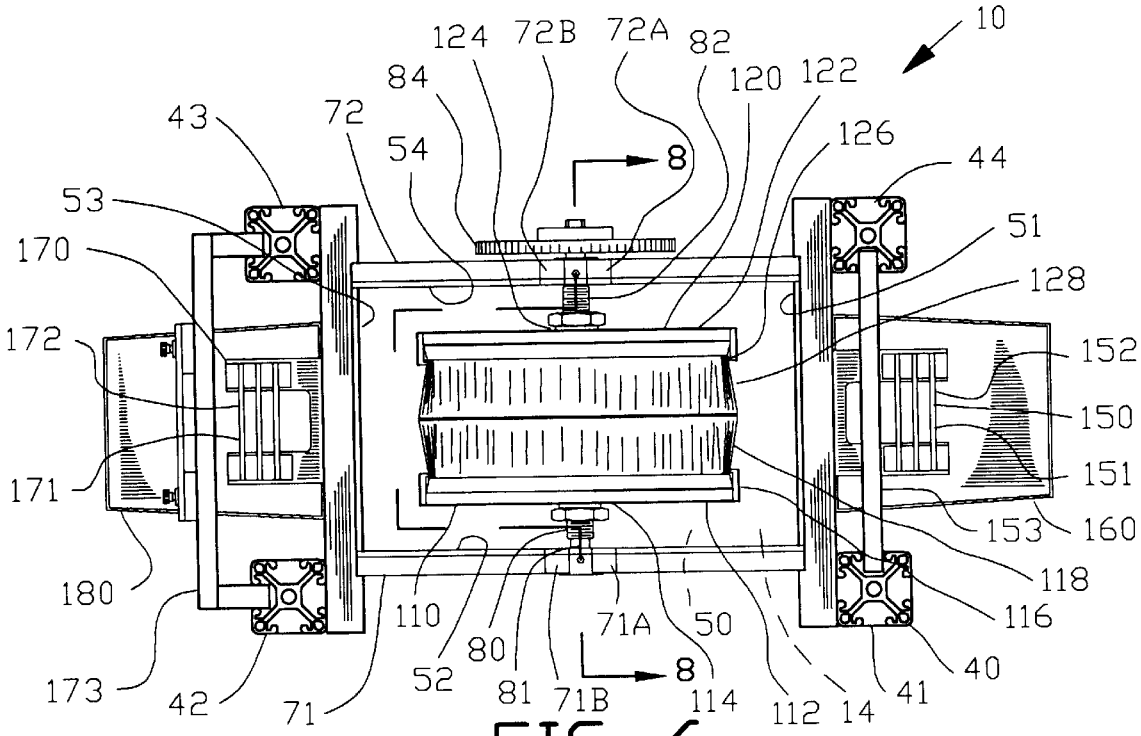
FIG. 6 is a top view of FIG. 5.
Figure 8:
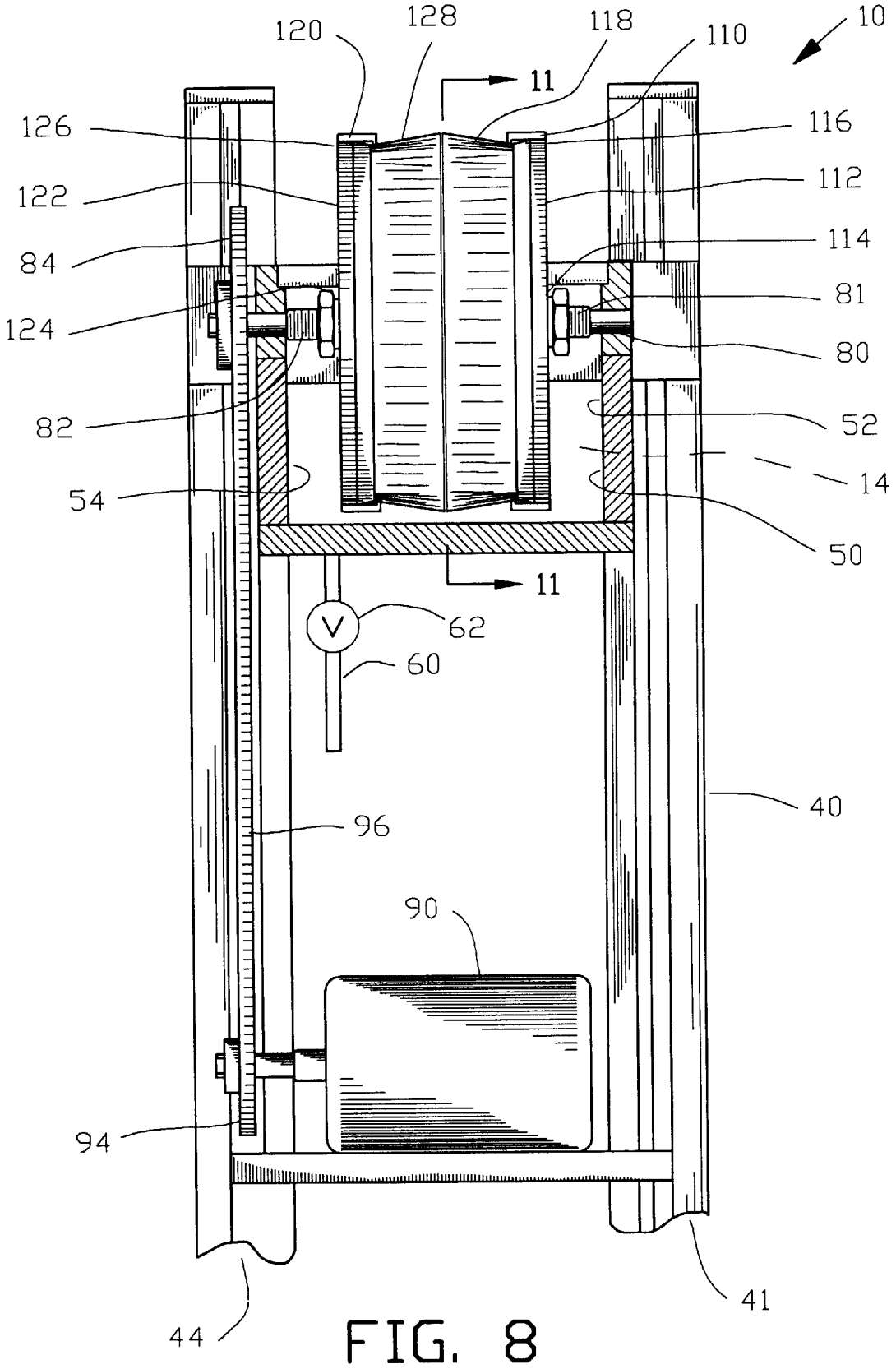
FIG. 8 is a view along line 8—8 of FIG. 6.

As best shown in FIGS. 6 and 8, an axle sprocket 84 is affixed to the second end 82 of the axle 80. A motor 90 is located on the frame 40 for rotating a motor sprocket 94. The axle sprocket 84 is operatively connected to the motor sprocket 94 by a chain 96. Although the axle 80 has been shown to be operatively connected to the motor 90 by plural sprockets 84 and 94 and a chain 96, it should be understood that various other means may be used to rotate the axle 80.

The axle 80 supports a first and a second cleaning component 110 and 120. The first cleaning component 110 comprises a generally circular disk 112 having a central aperture 114 for receiving the axle 80. The generally circular disk 112 is secured to the axle 80 for rotation therewith. The circular disk 112 defines a periphery 116. A plurality of brushes 118 extend generally axially from the periphery 116 of the circular disk 112.

In a similar manner, the second cleaning component 120 comprises a generally circular disk 122 having a central aperture 124 for receiving the axle 80. The generally circular disk 122 is secured to the axle 80 for rotation therewith. The circular disk 122 defines a periphery 126. A plurality of brushes 128 extend generally axially from the periphery 126 of the circular disk 122.

Figure 12:
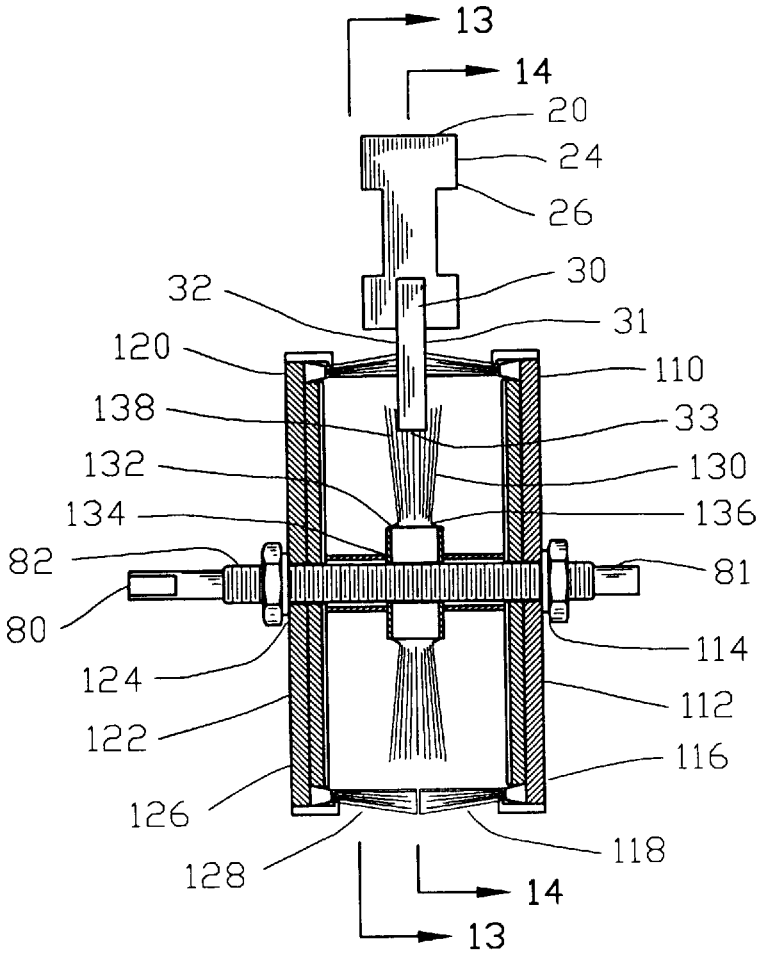
FIG. 12 is an enlarged sectional view along line 12—12 of FIG. 5.

As best shown in FIG. 12, an optional third cleaning component 130 comprises a generally circular disk 132 having a central aperture 134 for receiving the axle 80. The generally circular disk 132 is secured to the axle 80 for rotation therewith. The circular disk 132 defines a periphery 136. A plurality of brushes 138 extend generally radially from the periphery 136 of the circular disk 132.

The first and second axle inserts 71A and 72A may be slidably removed from the keyed recesses 71B and 72B to enable the axle 80 and the first and second cleaning components 110 and 120 to be remove from the frame 40. The first and second axle inserts 71A and 72A allow the axle 80 and the first and second cleaning components 110 and 120 to be remove rapidly from the frame 40 for cleaning and repair.

An input scraper assembly 150 is located in proximity to the first and second cleaning components 110 and 120 for scraping the paint pigment 16 from the blade 30 prior to cleaning by the first and second cleaning components 110 and 120. The input scraper 150 comprises a first and a second plurality of flexible wipers 151 and 152 for wiping the first and second lateral sides 31 and 32 of the semi-flexible blade 30. The input scraper assembly 150 includes a bottom wiper 153 for wiping the bottom surface 33 of the semi-flexible blade 30. The first and second plurality of flexible wipers 151 and 152 are secured relative to the frame 40.

The flexibility of the first and second plurality of flexible wipers 151 and 152 provide a dual function in the present invention. Firstly, the first and second plurality of flexible wipers 151 and 152 remain in the position shown in FIGS. 6 and 7 for providing a seal for the enclosure of the first and second cleaning components 110 and 120. Secondly, the first and second plurality of flexible wipers 151 and 152 provide a bias engagement with the first and second lateral sides 31 and 32 of the semi-flexible blade 30 for wiping accumulated material 16 from the semi-flexible blade 30.

The bottom wiper 153 is slidably mounted between the vertical supports 41 and 44. Preferably, the bottom wiper 153 is supported by a spring to resiliently engage with the bottom surface 33 of the semi-flexible blade 30. The resilient engagement of the bottom wiper 153 with the bottom surface 33 of the semi-flexible blade 30 enables the bottom wiper 153 to wipe accumulated material 16 from the semi-flexible blade 30.

Preferably, the apparatus 10 includes an input tray 160 for collecting any printing pigment removed from the blade 30 by the input scraper 150. The printing pigment 16 removed by the scraper 150 from the blade 30 will fall by action of gravity into the input tray 150 and will continue to move by action of gravity through the input tray 160 into the reservoir 50.

The invention also includes an output scraper 170 for removing any residual cleaning fluid 14 from the blade 30. The output scraper 170 comprises a first and a second plurality of flexible wipers 171 and 172 for wiping the first and second lateral sides 31 and 32 of the semi-flexible blade 30. The output scraper assembly 170 includes a bottom wiper 173 for wiping the bottom surface 33 of the semi-flexible blade 30. The first and second plurality of flexible wipers 171 and 172 are secured relative to the frame 40.

In a manner similar to the first and second plurality of flexible wipers 151 and 152, the flexibility of the first and second plurality of flexible wipers 171 and 172 provide a dual function in the present invention. Firstly, the first and second plurality of flexible wipers 171 and 172 remain in the position shown in FIGS. 6 and 7 for providing a seal for the enclosure of the first and second cleaning components 110 and 120. Secondly, the first and second plurality of flexible wipers 171 and 172 provide a bias engagement with the first and second lateral sides 31 and 32 of the semi-flexible blade 30 for wiping residual cleaning fluid 14 from the semi-flexible blade 30.

The bottom wiper 173 is slidably mounted between the vertical supports 42 and 43. Preferably, the bottom wiper 173 is supported by a spring to resiliently engage with the bottom surface 33 of the semi-flexible blade 30. The resilient engagement of the bottom wiper 173 with the bottom surface 33 of the semi-flexible blade 30 enables the bottom wiper 173 to wipe residual cleaning fluid 14 from the semi-flexible blade 30. The residual cleaning fluid 14 removed by the output scraper 170 is directed by action of gravity through an output tray 180 into the reservoir 50.

Figure 2:
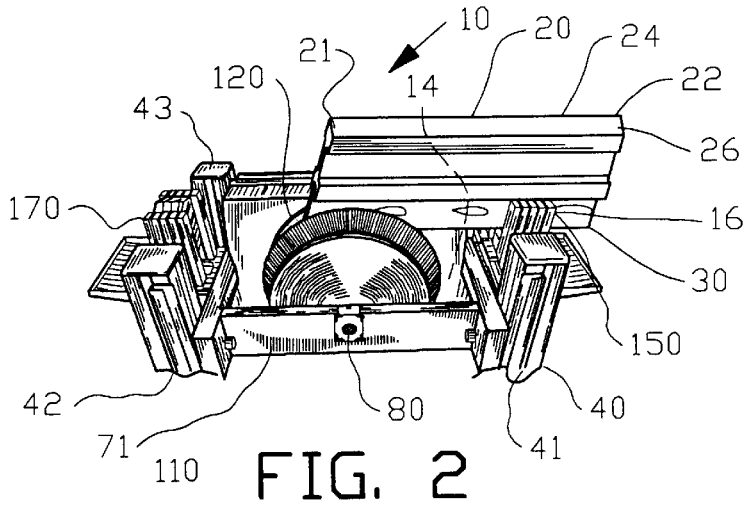
FIG. 2 is an isometric view similar to FIG. 1 illustrating the cleaning of the longitudinally extending member.
Figure 3:
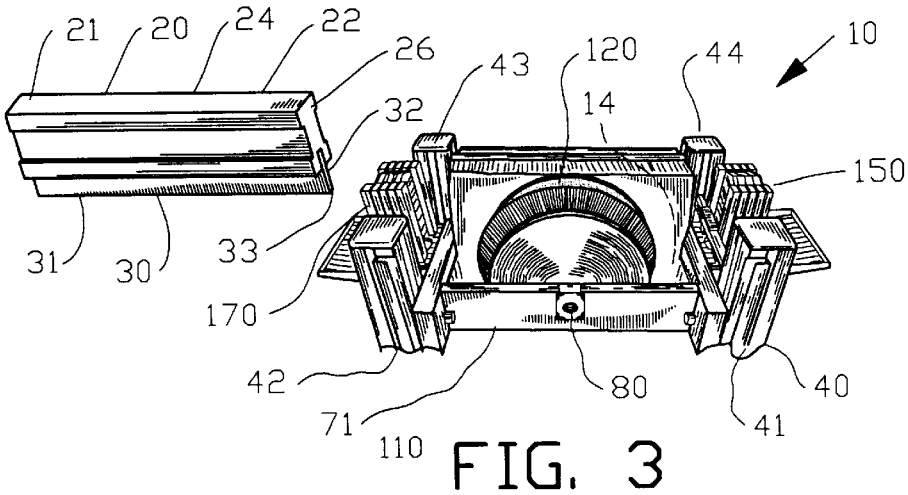
FIG. 3 is a view similar to FIG. 2 illustrating the completion of the cleaning of the longitudinally extending member.
Figure 4:
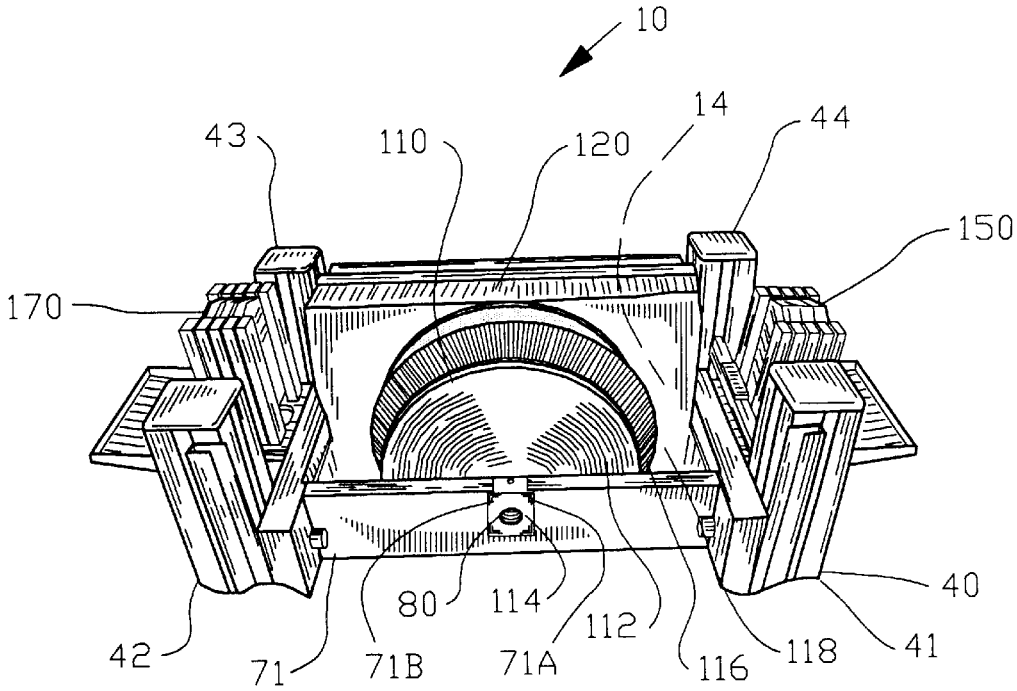
FIG. 4 is an enlarged view of the apparatus of FIGS. 1–3.
Figure 5:
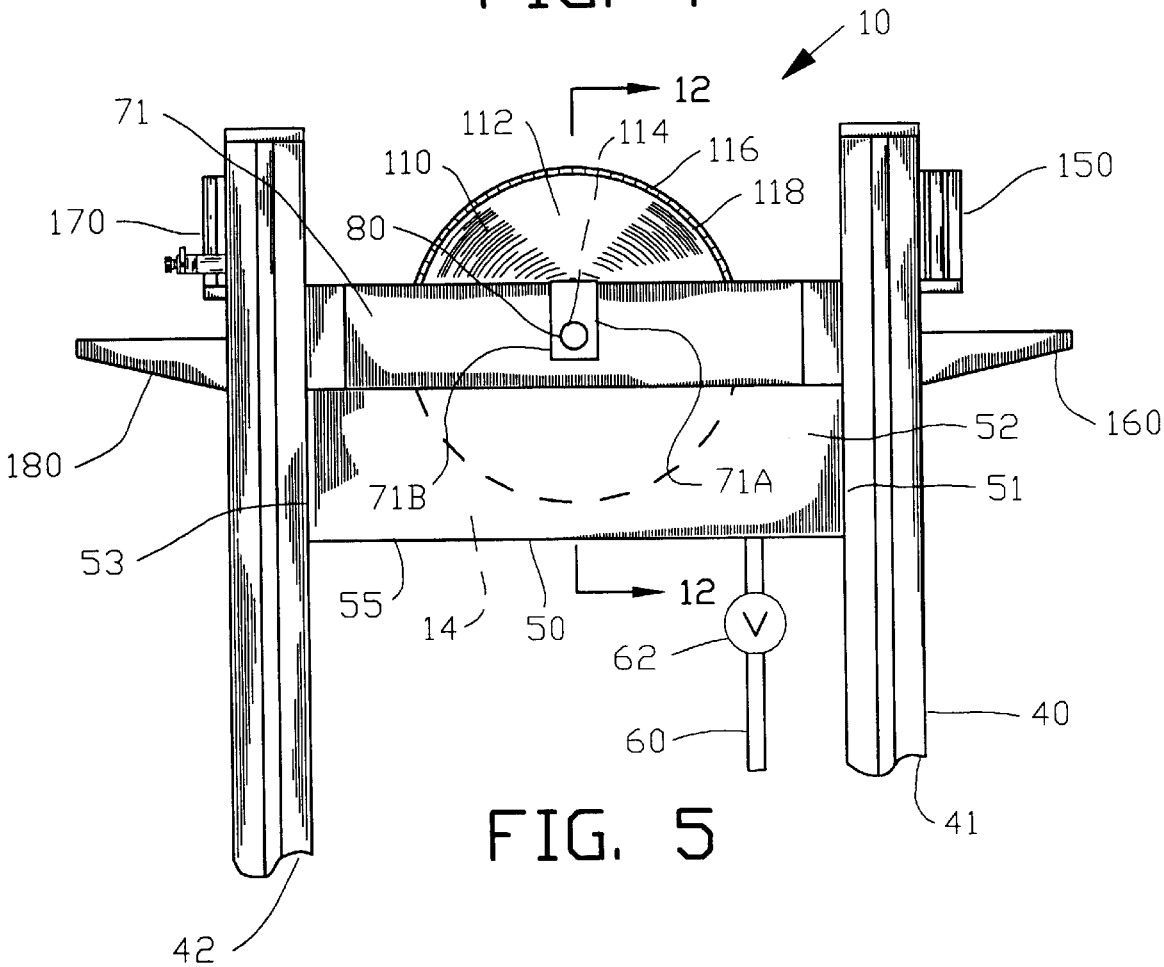
FIG. 5 is a side view of FIG. 4.
Figure 7:
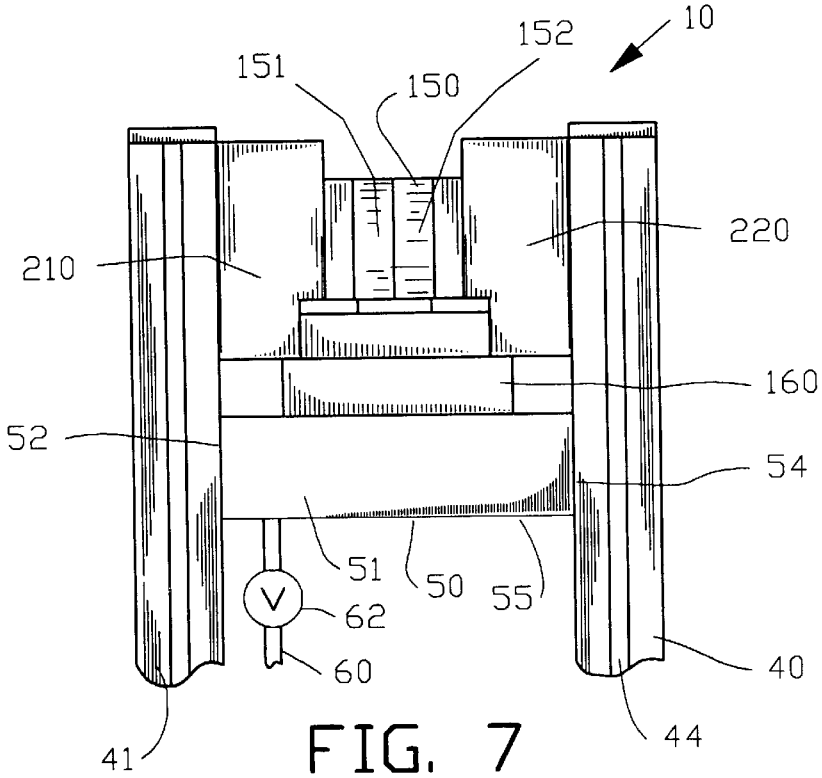
FIG. 7 is an end view of FIG. 6 showing the installation of protective covers.
Figure 9:
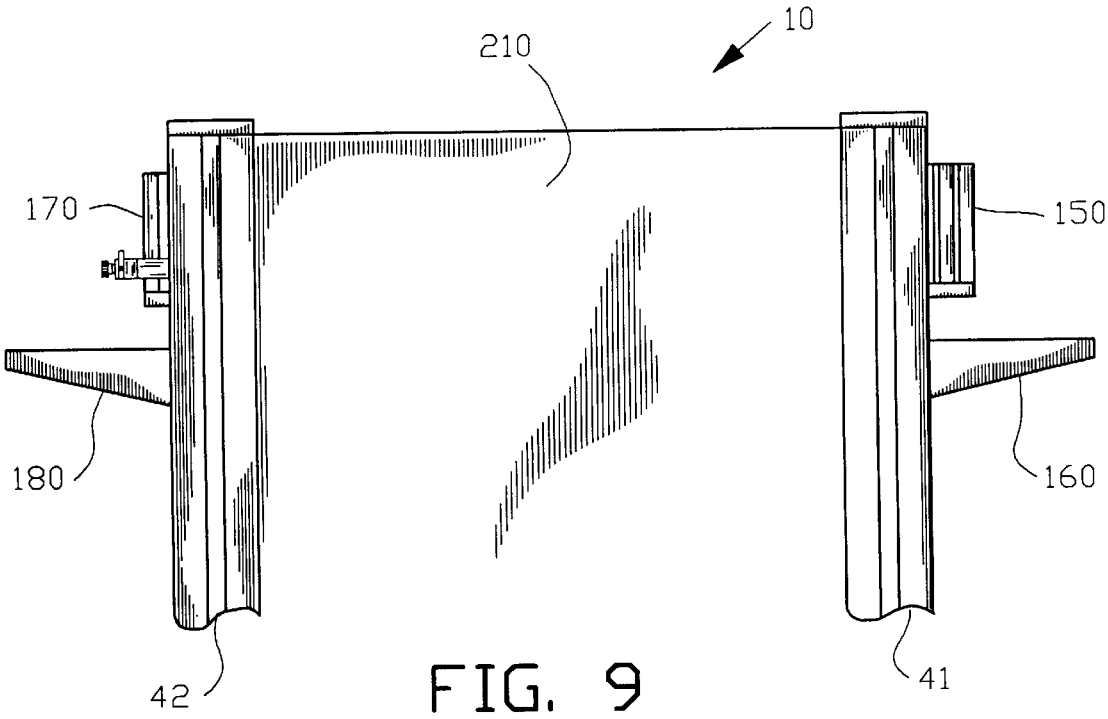
FIG. 9 is an enlarged side view of the apparatus of FIGS. 1–3 showing the installation of protective covers.
Figure 10:
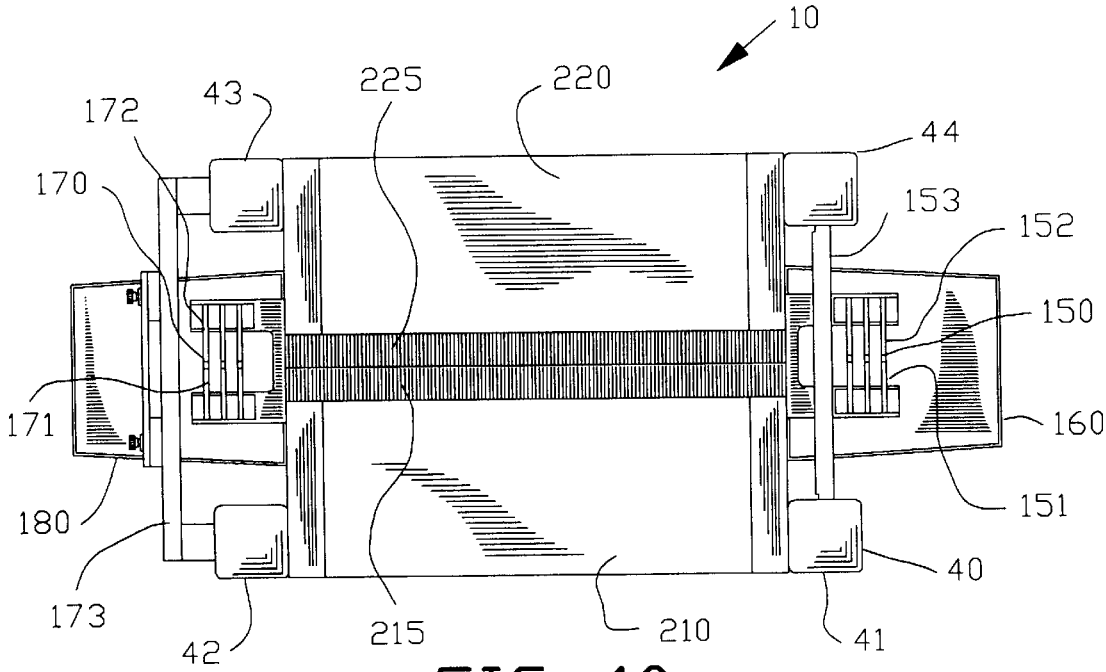
FIG. 10 is a top view of FIG. 9.
Figure 11:
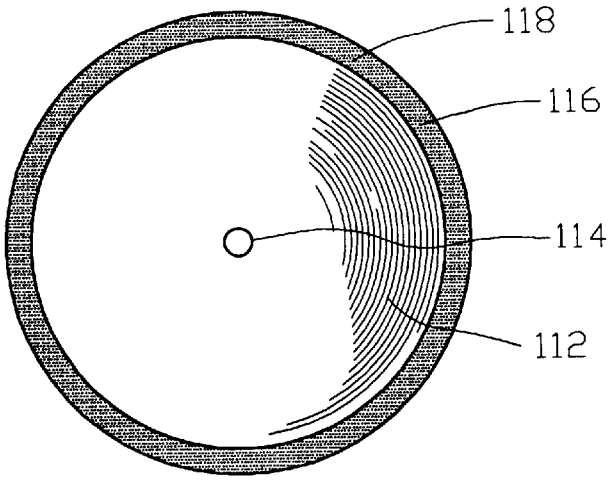
FIG. 11 is a view along line 11—11 of FIG. 8.

FIGS. 7, 9 and 10 are enlarged views of the apparatus 10 of FIGS. 1–3 showing the installation of protective covers 210 and 220. The protective covers 210 and 220 include brushes 215 and 225 respectively secured to the protective covers 210 and 220. The protective covers 210 and 220 with brushes 215 and 225 in combination with the input and output scrapers 150 and 170 create a cleaning chamber enclosing the first and second cleaning components 110 and 120. The cleaning chamber inhibits the discharge of cleaning fluid 14 and/or accumulated material 16 by the rotating first and second cleaning components 110 and 120.

FIG. 1 illustrates the longitudinally extending member 20 positioned adjacent to the apparatus 10. The longitudinally extending member 20 may be positioned by holding the handle 26 of the longitudinally extending member 20 by an operator in a mechanical cleaning process. In the alternative, an automated guide system (not shown) may be incorporated with the present invention for automatically feeding the longitudinally extending member 20 through the apparatus 10.

Figure 13:
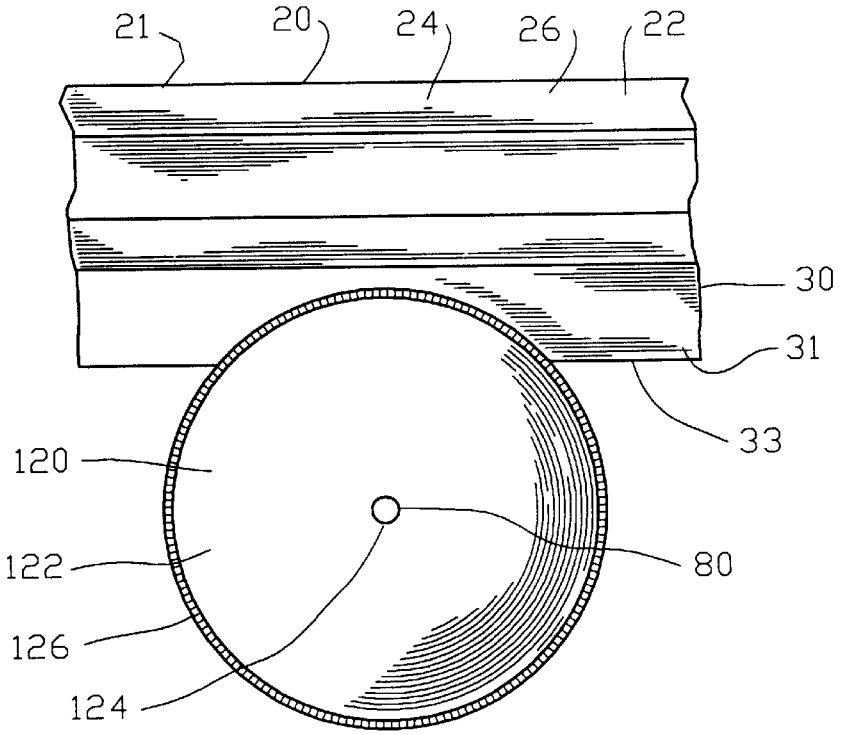
FIG. 13 is a sectional view along line 13—13 of FIG. 12.
Figure 14:
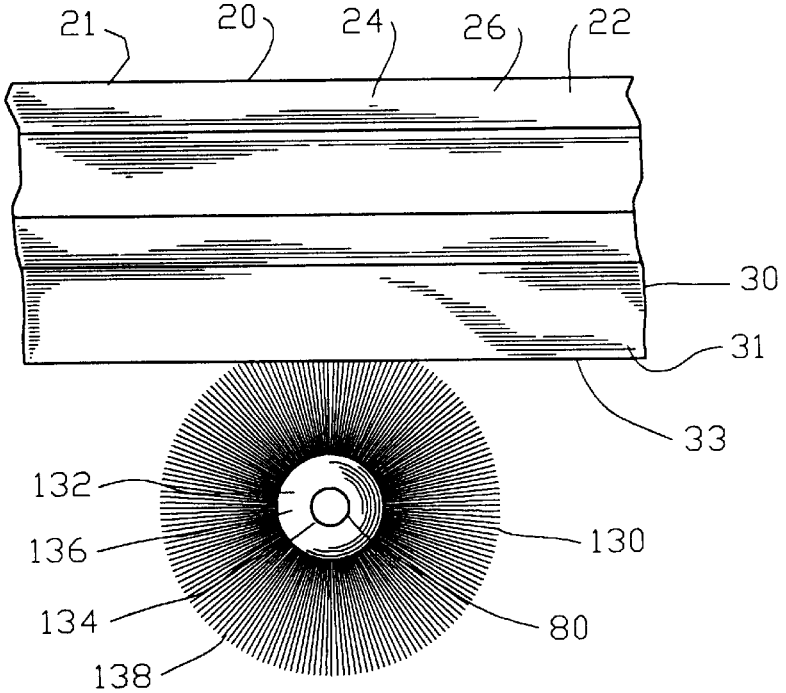
FIG. 14 is a sectional view along line 14—14 of FIG. 12.

FIG. 2 illustrates the introduction of the first end 21 of the blade 30 of the longitudinally extending member 20 between the first and second cleaning components 110 and 120. FIGS. 12–14 are enlarged views of the longitudinally extending member 20 positioned between the first and second cleaning components 110 and 120.

The first and second cleaning components 110 and 120 apply the cleaning fluid 14 and scrub the first and second lateral surfaces 31 and 32 of the blade 30 upon rotation of the first and second cleaning components 110 and 120. Upon the rotation of the first and second cleaning components 110 and 120, the first and second brushes 118 and 128 constantly apply additional cleaning fluid 14 to the blade 30. Simultaneously therewith, any printing pigment 16 affixed to the first and second brushes 118 and 128 are subjected to the cleaning fluid 14 for cleaning the first and second brushes 118 and 128 upon rotation into the cleaning fluid 14 within the reservoir 50. The optional third cleaning component 130 is disposed within the first and second cleaning components 110 and 120 for cleaning the bottom surface 33 of the blade 30.

FIG. 3 illustrates the completion of the cleaning process whereby the longitudinally extending member 20 has been passed totally through the apparatus 10. The apparatus 10 enables an operator to pass the longitudinally extending member 20 through the apparatus 10 at a speed necessary for insuring proper cleaning of the longitudinally extending member 20. Furthermore, the apparatus 10 allows the operator to pass the longitudinally extending member 20 through the apparatus 10 a second time in the remote event that the longitudinally extending member 20 was not totally cleaned during the first cleaning process.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An apparatus for cleaning a longitudinally extending member with a cleaning fluid, the longitudinally extending member having a first and a second lateral side and a bottom surface, comprising:

a frame supporting a reservoir for holding the cleaning fluid;

an axle being rotatably supported relative to said frame and located above said reservoir;

a first and second substantially circular support defining a first and second periphery disposed on said axle in a spaced apart relationship;

a first and a second plurality of cleaning brushes extending axially from said first and second peripheries of said first and second circular support;

said first and second plurality of cleaning brushes being disposed in a facing relationship and in close proximity to one another;

at least a portion of said first and second cleaning brushes extending into said reservoir for contacting the fluid cleaner therein;

a third circular support defining a third periphery disposed on said axle intermediate of said first and second circular supports with said third circular support having a smaller diameter than said first and second circular supports;

a third plurality of cleaning brushes extending radially outwardly from said third periphery of said third circular support; and a motor operatively connected to said axle for rotating said first, second and third cleaning brushes to clean the longitudinally extending member upon the insertion of the longitudinally extending member between said first and second cleaning brushes with said first and second cleaning brushes respectively cleaning at least the first and second lateral sides of the longitudinally extending member and with said third brushes cleaning the bottom surface of the longitudinally extending member.

2. An apparatus for cleaning a longitudinally extending member as set forth in claim 1, wherein said reservoir comprises an open top container.

3. An apparatus for cleaning a longitudinally extending member as set forth in claim 1, including an output tray secured relative to said frame; and said output tray receiving cleaning fluid draining from the longitudinally extending member and returning the cleaning fluid to said reservoir.

4. An apparatus for cleaning a longitudinally extending member as set forth in claim 1, including a removable cover for covering said first and second brushes.

5. An apparatus for cleaning a longitudinally extending member as set forth in claim 1, including an input scraper for scraping the first and second lateral side of the longitudinally extending member prior to engagement of the longitudinally extending member with the first and second cleaning brushes.

6. An apparatus for cleaning a longitudinally extending member as set forth in claim 1, including an output scraper for removing remaining cleaning fluid from the longitudinally extending member.

7. An apparatus for cleaning a longitudinally extending member with a cleaning fluid, comprising:

a frame supporting a reservoir for holding the cleaning fluid;

an axle being rotatably supported relative to said frame and located above said reservoir;

a first and a second cleaning brush mounted for rotation on said axle with at least a portion of said first and second cleaning brushes extending into said reservoir for contacting the fluid cleaner therein;

a motor operatively connected to said axle for rotating said first and second cleaning brushes to clean the longitudinally extending member upon the insertion of the longitudinally extending member between said first and second cleaning brushes;

a first and a second removable cover for covering said first and second cleaning brushes, respectively;

said first and second removable cover defining a slot therebetween for enabling the introduction of the longitudinally extending member therethrough for insertion between said first and second cleaning brushes; and a first and a second flexible brush for covering said slot to enclose said first and second cleaning brushes while enabling the longitudinally extending member to be inserted through said slot upon deflection of said first and second flexible brushes.

8. An apparatus for cleaning a longitudinally extending member with a cleaning fluid, the longitudinally extending member having a first and a second lateral side and a bottom surface, comprising:

a frame supporting a reservoir for holding the cleaning fluid;

an axle being rotatably supported relative to said frame and located above said reservoir;

a first and second substantially circular support defining a first and second periphery disposed on said axle in a spaced apart relationship;

a first and a second plurality of cleaning brushes extending axially from said first and second peripheries of said first and second circular support with said first and second plurality of cleaning brushes being disposed in a facing relationship;

at least a portion of said first and second cleaning brushes extending into said reservoir for contacting the fluid cleaner therein;

a third circular support defining a third periphery disposed on said axle intermediate of said first and second circular supports with said third circular support having a smaller diameter than said first and second circular supports;

a third plurality of cleaning brushes extending radially outwardly from said third periphery of said third circular support;

said first plurality of cleaning brushes being in close proximity to said second plurality of cleaning brushes for substantially enclosing said third plurality of cleaning brushes within said first and second substantially circular supports and said first and second plurality of cleaning brushes; and a motor operatively connected to said axle for rotating said first, second and third cleaning brushes to clean the longitudinally extending member upon the insertion of the longitudinally extending member between said first and second cleaning brushes with said first and second cleaning brushes respectively cleaning at least the first and second lateral sides of the longitudinally extending member and with said third brushes cleaning the bottom surface of the longitudinally extending member.

* * * * *